US005154212A

United States Patent [19]

Weber

[11] Patent Number: 5,154,212

[45] Date of Patent: Oct. 13, 1992

[54] DISPENSER FOR A LAUNDRY AGENT

[76] Inventor: William C. Weber, 3603 W. Lake Shore Dr., Crystal Lake, Ill. 60014

[21] Appl. No.: 705,603

[22] Filed: May 24, 1991

[51] Int. Cl.[5] ..... B65B 1/04

[52] U.S. Cl. ..... 141/353; 141/363; 222/501; 222/518

[58] Field of Search ..... 141/351, 353, 357, 388, 141/360, 362; 222/158, 185, 482, 501, 518

[56] References Cited

U.S. PATENT DOCUMENTS

| | | | |
|---|---|---|---|
| 525,232 | 8/1894 | Reese et al. | 222/157 |
| 919,943 | 4/1909 | Peterson | 222/158 |
| 983,058 | 1/1911 | Jackson | 222/158 |
| 1,081,151 | 12/1913 | Ritter | 222/160 |
| 1,362,831 | 12/1920 | Altenberg | 222/181 X |
| 2,077,980 | 4/1937 | Bell | 222/181 X |
| 2,275,703 | 3/1942 | Trester et al. | 222/518 X |
| 2,337,276 | 12/1943 | Sanchis | 222/501 X |
| 2,339,644 | 1/1944 | Lucas | 222/425 |
| 2,469,746 | 5/1949 | Sanchis | 222/501 X |
| 2,547,744 | 4/1951 | Burger | 141/360 |
| 2,723,783 | 11/1955 | Ewin | 222/248 |
| 2,946,489 | 7/1960 | Brucken | 222/160 |
| 3,042,085 | 7/1962 | Morris | 141/353 |
| 3,044,667 | 7/1962 | Lucas | 222/454 |
| 3,217,939 | 11/1965 | Murray | 222/501 X |
| 3,228,568 | 1/1966 | Harr | 222/185 X |
| 4,421,147 | 12/1983 | Cannella | 141/362 |

FOREIGN PATENT DOCUMENTS

| | | | |
|---|---|---|---|
| 48344 | 9/1910 | Austria | 222/518 |

*Primary Examiner*—Andres Kashnikow
*Assistant Examiner*—Kenneth Bomberg
*Attorney, Agent, or Firm*—Mathew R. P. Perrone, Jr.

[57] ABSTRACT

A container for dispensing a laundry agent rests on a shelf adjacent the clothes washer, with a portion of the container extending over the edge of the shelf, having a measuring device removably positioned on the portion. The container is easily refillable through a large, closeable opening in the top thereof.

9 Claims, 2 Drawing Sheets

DISPENSER FOR A LAUNDRY AGENT

This invention relates to a dispenser, and more particularly to a dispenser especially suitable for use in dispensing an agent suitable for use in the washing of clothes, commonly known as doing laundry.

BACKGROUND OF THE INVENTION

Many important actions are unpleasant. Under almost no circumstances is washing clothes or doing laundry a pleasant condition. One of the factors that adds to the unpleasantness of this necessary function of life is the application of the appropriate type and amount of soap, bleach, conditioner or other washing material or laundry agent to the clothes washer. If the container for one of these materials is small enough to be lifted easily, it is an inefficient use of a container and has an expensive purchase price for the material. If the container is large enough to be economical, the container can be too heavy to be lifted easily—let alone dispensed from easily.

There is also a certain amount of skill required for doing the laundry (that is to say, appropriately washing clothes). The terms doing laundry, washing clothes and variations thereon are used interchangably. It is desired to determine the appropriate amount of soap, bleach, conditioner or other washing material to be added to the washer. This feature of doing laundry can be cumbersome without, at least, a minimal amount of knowledge regarding this matter. It is desired to simplify these matters of determining the amount, dispensing the amount and adding the appropriate amount to the washer in an effective and efficient manner.

Thus, it may be seen that measured dispensing and convenient storage add to the complications of doing laundry. Accordingly, a device, which solves or at least minimizes these problems, is highly desirable.

SUMMARY OF THE INVENTION

Accordingly, among the many objectives of this invention, is to provide a suitable container permitting efficient refilling and dispensing of laundry agents.

A further objective of this invention is to provide an easily refillable container.

A still further objective of this invention is to provide a container for dispensing a laundry agent into a measuring device.

Yet a further objective of this invention is to provide a container for dispensing a laundry agent which removably retains the measuring device.

Also an objective of this invention is to provide a container for dispensing a laundry agent which has an easily operable dispensing valve.

Another objective of this invention is to provide a container for dispensing a laundry agent which simplifies the determination of the amount thereof.

Still another objective of this invention is to provide a container for dispensing a laundry agent which simplifies storage of the laundry agent.

Yet another objective of this invention is to provide a container for dispensing a laundry agent which provides for economical use of the laundry agent.

These and other objectives of this invention (which other objectives become clear by considering the specification, claims and drawings as a whole) are met by providing a container for dispensing a laundry agent capable of resting on a shelf adjacent the clothes washer, with a portion, extending over the edge of a shelf, having a measuring device removably positioned on the extending portion. The container is easily refillable through a large, closeable opening in the top thereof.

BRIEF DESCRIPTION OF DRAWINGS

Throughout the figures of the drawing where the same part appears in more than one figure of the drawing, the same number is applied thereto.

DESCRIPTION OF THE PREFERRED EMBODIMENTS

Figure 1:
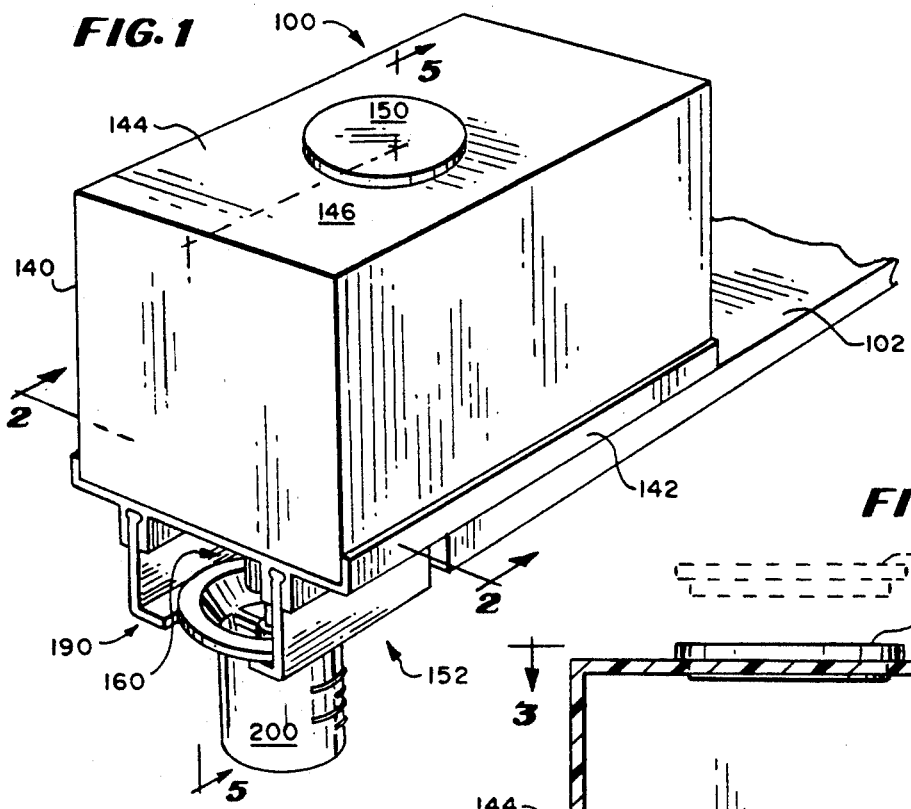
FIG. 1 is a front perspective view of dispenser 100 used for dispensing a laundry agent of this invention as supported by a shelf 102 and including a measuring cup 200.
Figure 2:
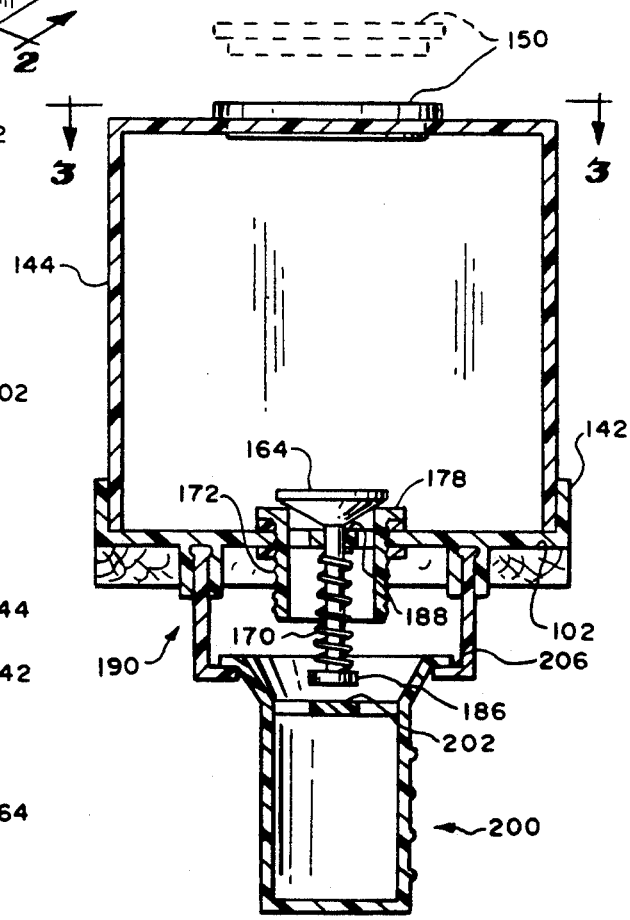
FIG. 2 is a front, sectional view of dispenser 100 used for dispensing a laundry agent of this invention shown in cross-section taken along Line 2—2 of FIG. 1.

A dispenser having a container of sufficient size to rest on a shelf and sufficient length so that a dispensing mechanism is held conveniently for use provides the necessary solutions to the problems described above. The container can rest on a shelf above the washer. The container can be of sufficient size to hold a suitable amount of powder or liquid for washing purposes.

Preferably, the container has a flat base so that the container rest easily on a shelf mounted adjacent to the clothes washer. The container, at least partially, overhangs the shelf. At the overhanging portion of the container, there is a valve mechanism in the flat base. A clipping mechanism is mounted on the base below the valve. Into the clipping mechanism, can fit a cup marked for measuring the amount of material, which can be removably held therein.

When it is desired to do laundry, it is possible to elevate the cup to open the valve, to fill the cup with the desired amount of material, close the valve and to remove the cup from the clips. Then the content of the cup can be added to the clothes washer in order to do the laundry. The cup may be marked in Braille or levels for the amount of material necessary for each load or size of load of laundry. In this fashion, the laundry process may be more simply accomplished.

A dispenser of this type avoids the problems caused by a number of soap containers, bleach containers, conditioner containers, and other containers around the laundry area. It also avoids the application of the material from and eliminates the need for lifting a gallon container or other heavy item for handling this matter. It also simplifies the application of the right amount of the product at the right time, thereby reducing waste and minimizing other problems. The cup can also be marked to make it simpler for a person lacking laundry skills to determine how much of each laundry material is to be used. For those without the strength to lift a heavy container, this dispenser and container keep the washing material readily available.

It is possible to make the dispenser of a clear plastic so that it can be easily determined when the product contained therein is running low, and when the dispenser needs to be refilled. The dispenser may be made of transparent material, translucent material, opaque material or any reasonable combination thereof. The only requirement is that the material be inert to the laundry agent contained therein. Because the whole dispenser unit can be taken down from the shelf, and placed on the washer or other surface to be filled, and the filling aperture in the top of the unit is large, it is easy to refill.

Two plastic rails snap onto (or are otherwise secured to) the bottom of the container under the valve to form a clip and hold the dispenser cup. The snapping device may also be replaced by a permanent fixture or other suitable fixture. The cup preferably has a flat bottom so that once it is removed from the clip, it can be placed on a suitable flat surface if desired rather than returned each time to the clip. The only moving part of this device is a spring valve or gravity ball valve that efficiently closes the device when dispensing is not desired and opens it efficiently to dispense the desired amount of material.

More than one dispenser can be placed on a shelf adjacent to a clothes washing machine. Each dispenser can dispense a different desired laundry agent. Thus a plurality of laundry agents may be used, kept handy for use and dispensed easily. The laundry agent may be in liquid form, in powdered form, or in another suitable form.

Referring now to FIG. 1, dispenser 100 includes a container 140, a valve assembly 160, a clip assembly 190, and a measuring cup 200. Container 140 is of sufficient size to rest on a shelf 102 and sufficient length so that valve assembly 160 and clip assembly 190 extend over the edge of shelf 102. This structure simplifies dispensing of the laundry agent. The container 140 can be of sufficient size to hold a suitable amount of powder or liquid for washing purposes.

Figure 4:
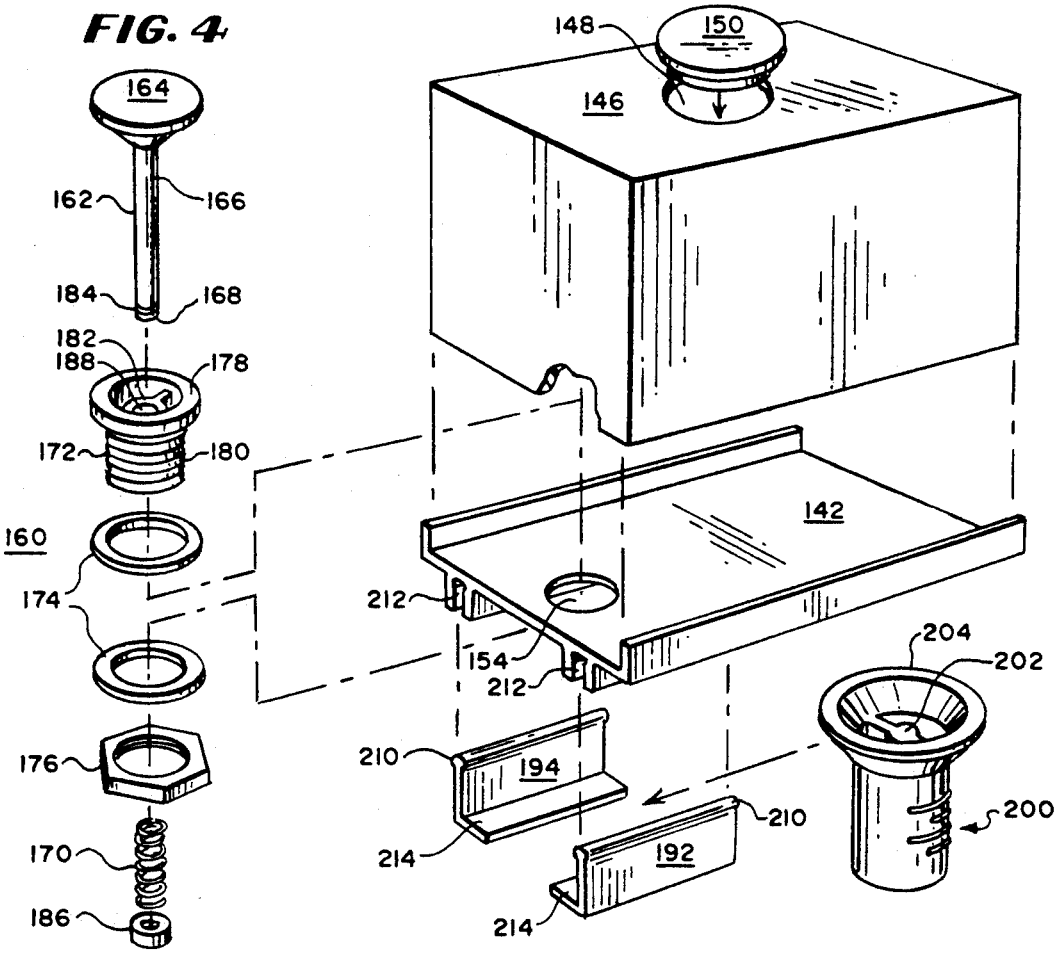
FIG. 4 is an exploded, front, perspective view of dispenser 100 used for dispensing a laundry agent of this invention as supported by a shelf 102 and including a measuring cup 200.
Figure 5:
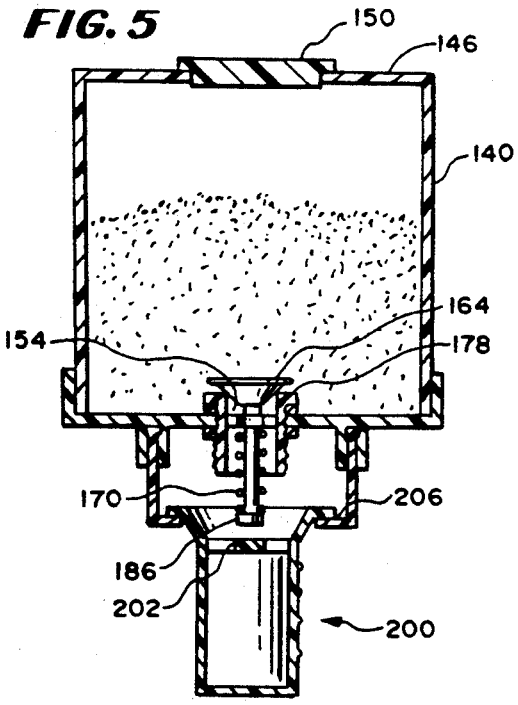
FIG. 5 is a front, sectional view of dispenser 100 used for dispensing a laundry agent of this invention shown in cross-section taken along Line 5—5 of FIG. 1, with valve assembly 160 in a closed position.
Figure 6:
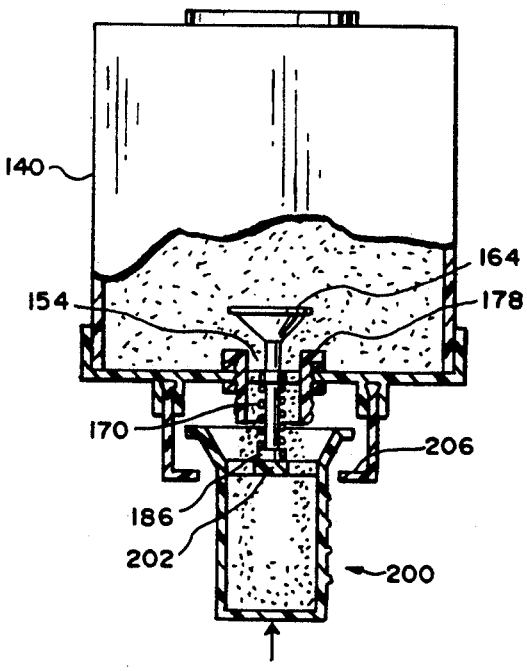
FIG. 6 is a front view in partial cross-section of the valve assembly 160 in an open position as used with dispenser 100.

With consideration of FIG. 1 and FIG. 4, preferably there is a flat base 142 clipped or otherwise secured to the container 140 in a liquid or powder tight fashion as desired, so that it will rest easily on the shelf 102. Adjacent the container 140 at least partially overhanging the shelf 102 are valve assembly 160 and clip assembly 190. Into the clip assembly 190 fits measuring cup 200.

Figure 3:
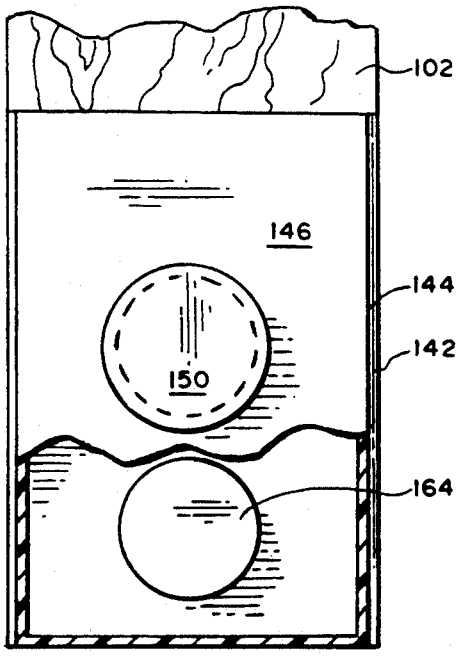
FIG. 3 is a top, partially sectional, plan view of dispenser 100 used for dispensing a laundry agent of this invention shown in partial cross-section taken along line 3—3 of FIG. 2.

The container 140 further includes a hollow rectangular member 144 capable of being secured to flat base 142. The hollow rectangular member 144 cooperates with flat base 142 to complete container 140. In a top 146, of hollow rectangular member 144 is a large filling aperture 148 (also shown in FIG. 3) closeable by a removable stopper 150. Thus container 140 can be filled easily.

Flat base 142 has, at one end thereof, a shelf overhanging section 152, which includes the valve assembly 160 and the clip assembly 190. Shelf overhanging section 152 protrudes beyond shelf 102 and permits access to measuring cup 200. Within shelf overhang section 152 is valve aperture 154 for valve assembly 160. The protrusions caused by valve assembly 160 and clip assembly 190 do not interfere with container 140 resting on shelf 102 due to fact that neither touch the shelf 102.

Within FIG. 2, FIG. 4, FIG. 5 and FIG. 6, valve assembly 160 has a valve body 162. Valve body 162 includes a closure member 164 at one end thereof of sufficient size and strength to close valve aperture 154 in a liquid or powder tight fashion as required. Closure member 164 is an enlarged portion of valve body 162. Valve body 162, tapers from closure, member, 164 (closure member 164 having a generally truncated, conical shape) to a substantially straight cylindrical operating rod 166 and terminates in activation knob 168.

Operating rod 166 is encircled by sealed spring 170 holding valve body 162 in position to close valve aperture 154. By sealed spring is meant a suitable spring inert to a laundry agent. Valve body 162 is mounted in threaded housing 172. Threaded housing 172 slides into valve aperture 154 and is sealed therein by a pair of sealing washers 174 and a valve nut 176. The valve aperture 154 is sandwiched between the washers 174. One of washer 174 is on either side of valve aperture 154. Threaded housing 172 includes an enlarged mounting ledge 178 which engages within container 140 and a threaded member 180 extending downwardly therefrom to which nut 176 is secured outside of container 140.

By considering FIG. 4, it may seen that within the generally hollow cylindrical threaded housing 172 is spring holding shelf 182 adjacent to closure member 164 to brace or otherwise support one end of spring 170. The other end of spring 170 is secured adjacent to activation knob 168. When in normal position, spring 170 closes valve aperture 154 with closure member 164. When spring 170 is forced into a compressed position, valve aperture 154 is open and permits a laundry agent in container 140 to flow into measuring cup 200.

Activation knob 168 is preferably formed by having a male threaded rod portion 184 on the end of operating rod 166 oppositely disposed from closure member 164. Onto threaded portion 184 is placed in threaded relation therewith spring nut 186. Spring nut 186 contacts an opposing end of spring 170, in order to cooperate with spring holding shelf 182 and render valve body 162 operable. Spring holding shelf 182 may include shelf aperture 188, which is large enough to permit operating rod 166 to pass therethrough, but too small to permit spring 170 to pass therethrough.

Clip assembly 190 includes a first L-shaped member 192 and a mirror image second L-shaped member 194 and suspends measuring cup 200 on dispenser 100. Such suspension is below valve opening 154. Measuring cup 200, when hanging from said clip assembly 190, is displaced from valve assembly 160.

Activating knob 168 may be brought into contact with measuring cup 200 when dispensing is desired. Measuring cup 200 includes an activation shelf 202 partially closing enlarged top 204 of measuring cup 200. Clip assembly 190 suspends activation shelf 202 from activation knob 168 by means of cup lip 206. Clip assembly 190 permits moving of activation shelf 202 against activation knob 168 and opening of valve aperture 154 to fill measuring cup 200.

The contents of the measuring cup 200 can be added to the washing machine. Furthermore, the measuring cup 200 may be marked in Braille or with levels for the amount of material necessary for each load or size of load of laundry. In this fashion, the laundry may be more simply accomplished.

First L-shaped member 192 and mirror image second L-shaped member 194 are preferably snap-mounted on flat base 142. Both have an elongated, generally tubular-shaped, enlarged portion 210 capable of snap or slide fitting into either of slots 212 and being held therein. Slots 212 are located on the exterior of flat base 142 adjacent to and on opposite sides of valve aperture 154. The enlarged portion 210 thus forms a mounting member for each of first L-shaped member 192 and second L-shaped member 194. The cup holding side 214 of each is oppositely disposed from the mounting member. Enlarged top 204 of cup 200 permits cup 200 to be held in clip assembly 190.

A dispenser 100 of this type avoids the problems caused by a plurality of soap containers, bleach containers, and conditioner containers around the laundry area. It also simplifies application of the material and eliminates the need for lifting a gallon container or other heavy item for handling this matter. It simplifies the application of the right amount of the product at the right time therefore reducing waste and other problems.

This application—taken as a whole with the specification, claims, abstract, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this method and apparatus can become clear to a person having ordinary skill in this particular art. Such modifications are clearly covered by this disclosure.

What is claimed and sought to be protected by Letters Patent of the United States is:

1. A dispenser to contain an agent suitable for use in doing laundry, wherein:

a. said dispenser includes a container means, a valve means for selectively removing a suitable portion of said agent from said container means, and a refilling means for refilling said container with said agent;

b. said container means is capable of resting on a shelf with a portion of said container means extending over an edge of said shelf;

c. said portion includes said valve means;

d. a measuring device is removably positioned adjacent to said valve means;

e. said measuring device includes an activating mechanism to cooperate with said valve means to dispense an amount of said agent into said measuring device;

f. said refilling means is situated in a top portion of said container means;

g. said container means includes a flat base member to rest on said shelf;

h. said flat base member includes a clipping means for removably holding said measuring device adjacent to said valve means on said portion of said container means extending over the edge of said shelf, said clipping means including a first and a second rails secured to said flat base member adjacent to said valve means;

i. said container means includes a hollow rectangular member;

j. said hollow rectangular member has an open side and an apertured side oppositely disposed from said open side;

k. said open side of said hollow rectangular member is secured to said flat base member in order to form said container means; and l. said valve means includes and has operably connected therewith an axially reciprocating operating means.

2. The dispenser of claim 1, wherein:

said container means is at least partially transparent;

3. The dispenser of claim 2, wherein:

a. said first plastic rail and said second plastic rail are secured to said flat base member by a snapping device; and b. said measuring device has a flat bottom so that once removed from said clipping means, said measuring device can be placed on a suitable flat surface.

4. The dispenser of claim 3, wherein:

said apertured side of said hollow rectangular member comprises said refilling means and is sealable by a stopper means for removably sealing said aperture.

5. The dispenser of claim 4, wherein:

a. said flat base includes said portion of said container means extending over said edge;

b. said portion includes a valve aperture to receive said valve means; and c. said valve means includes a valve body comprising said axially reciprocating operating means, a spring biasing said valve body, a threaded housing containing said valve body, at least one sealing washer sealing the container means with the threaded housing and a valve nut coupling the threaded housing to the container means at said valve aperture.

6. The dispenser of claim 5, wherein:

a. said valve body includes a closure member at one end thereof of sufficient size and strength to close and removably seal said threaded housing until opening thereof is required;

b. said closure member is an enlarged portion of valve body;

c. said closure member tapers to substantially straight cylindrical operating rod;

d. said operating rod terminates in an activation knob; and e. said activation knob is oppositely disposed from said closure member.

7. The dispenser of claim 6, wherein:

a. said valve body is slidably mounted in said threaded housing;

b. said threaded housing is bolted in said valve aperture;

c. said threaded housing includes a spring holding shelf to hold a first end of said spring;

d. said activation knob holds a second end of said spring; and e. said first end of said spring is oppositely disposed from said second end of said spring.

8. The dispenser of claim 7, wherein:

a. said activation knob includes a threaded portion of said operating rod and a holding nut in threaded relation therewith; and b. said threaded portion is adjacent said second end of said spring.

9. The dispenser of claim 8, wherein:

a. said first plastic rail comprises a first L-shaped member and said second plastic rail comprises a mirror image second L-shaped member to suspend said measuring device on said dispenser below said valve assembly in a displaced manner from said valve assembly;

b. said activation knob is capable of contacting said actuating mechanism as desired; and c. said actuating mechanism comprises an activation shelf partially closing an enlarged top of said measuring device.

* * * * *

UNITED STATES PATENT AND TRADEMARK OFFICE

CERTIFICATE OF CORRECTION

PATENT NO. : 5,154,212

DATED : October 13, 1992

INVENTOR(S) : William C. Weber

It is certified that error appears in the above-identified patent and that said Letters Patent is hereby corrected as shown below:

Title page: [76] on the Abstract page, Crystal Lake, Illinois 60014 should be Wonder Lake, Illinois 60097.

Signed and Sealed this

Fifth Day of October, 1993

*Attest:*

Bruce Lehman

BRUCE LEHMAN

*Attesting Officer*

*Commissioner of Patents and Trademarks*